United States Patent [19]

Outzen

[11] Patent Number: 4,729,723

[45] Date of Patent: Mar. 8, 1988

[54] CASING FOR HERMETICALLY ENCAPSULATED SMALL REFRIGERATORS

[75] Inventor: Svend E. Outzen, Sonderborg, Denmark

[73] Assignee: Danfoss A/S, Nordborg, Denmark

[21] Appl. No.: 6,882

[22] Filed: Jan. 27, 1987

[30] Foreign Application Priority Data

Feb. 18, 1986 [DE] Fed. Rep. of Germany ..... 3605021

[51] Int. Cl.[4] ..... F04B 21/00; F04B 35/04

[52] U.S. Cl. ..... 417/312; 417/902; 181/403

[58] Field of Search ..... 62/508, 469; 417/902, 417/312; 181/282, 403, 240, 202, 200, 198

[56] References Cited

U.S. PATENT DOCUMENTS 2,928,589 3/1960 Davey ..... 417/902 X
3,187,995 6/1965 Kjeldsen ..... 417/902 X
4,345,882 8/1982 Saito et al. ..... 417/902 X
4,384,635 5/1983 Lowery ..... 181/403
4,566,865 5/1986 Nishitsuji ..... 417/902 X

*Primary Examiner*—Leonard E. Smith
*Attorney, Agent, or Firm*—Wayne B. Easton; Clayton R. Johnson

[57] ABSTRACT

The invention relates to the design of a capsule for a hermetically encapsulated small refrigerator. The damping of noise is an important requirement and to this end it is conventional that the motor-compressor unit mounted in the capsule is resiliently mounted relative thereto. The radiation of noise generated in the capsule is thwarted by arranging opposite wall sections in non-parallel relationships so that a sound wave striking a wall section is prevented from being reflected to a parallel wall section which would be conducive to amplification by continuing reflection.

9 Claims, 4 Drawing Figures

CASING FOR HERMETICALLY ENCAPSULATED SMALL REFRIGERATORS

The invention relates to a casing for hermetically encapsulated small refrigerators consisting of a lower vessel and an upper cover interconnected along a welded edge.

Known casings of this kind (U.S. Pat. No. 4,106,881) consist of a vessel having vertical side walls over at least part of its height. Similarly, parts of the wall of the cover and the base are parallel to each other.

In hermetically encapsulated small refrigerators, the damping of noise if a very important object. For this reason, the motorcompressor is resiliently mounted. The pressure tube is likewise resilient so that the transmission of mechanical oscillations to the casing is to a large extent suppressed.

The invention is based on the problem of producing a still further reduction in the radiation of noise in casings of the aforementioned kind.

This problem is solved according to the invention in that the side walls of the casing are so inclined to each other beyond the weld seam that a line drawn perpendicular to any desired wall section meets the opposite wall section at an angle different from 90° in at least one plane.

By means of this construction, a sound-wave striking a wall section is prevented from being reflected by an opposite wall section and from being amplified by continued reflection. the side walls of the casing therefore have no inherent resonance for upright walls. The radiation of corresponding excitation frequencies or their harmonics is correspondingly low.

The danger of such upright waves is greatest for the side walls of the casing because, in comparison with the walls of the base and cover, they have a smaller curvature. However, desirably, the walls of the base and cover likewise to extend in relation to each other that a line drawn perpendicular to any wall section meets the opposite wall section at an angle different from 90° in at least one plane.

Altogether, one obtains a casing which radiates practically no noise. Its interior is much like a sound-proofed room.

A particular advantage is that casings of thinner wall thickness can be employed without the danger of undesirable radiation of noise.

Desirably, the angle of incidence departs by at least 5° from 90°. This will also practically eliminate a double or triple reflection.

It is preferable for the transverse walls at opposite ends of the vessel to have a smaller curvature in the horizontal section of at least its central portion than the central portions of the longitudinal walls therebetween and for the first transverse wall in the longitudinal vertical section to be substantially straight and vertical and the second transverse wall extending at an increasing angle to the vertical from top to bottom. This asymmetric construction of the vessel makes it particularly easy to avoid reflection.

The first transverse wall of the cover disposed above the first transverse wall of the vessel should be shallower than the second transverse wall of the cover and the maximum height of the cover should be disposed closer to the second than to the first transverse wall of the cover. This asymmetric construction of the cover makes it easier to avoid reflection between the wall of the cover and the wall of the base.

Preferably, in its vertical longitudinal section, the wall of the cover is more intensely curved near the second transverse wall than near the first transverse wall. In this way, the walls of the cover and vessel can likewise be constructed to be free from reflection.

Advantageously, a motor-compressor unit with a cylinder at the top is so installed that the cylinder is adjacent to the second transverse wall of the cover. This makes good use of the available space.

To secure the casing, it is recommended that the base have four depressions which have base surfaces arranged in a single plane disposed to both sides of the longitudinal central plane and are opposed to inclined regions of the wall of the cover. Despite the flat base surfaces, there will be no reflection.

A preferred example of the invention will now be described in more detail with reference to the drawing, wherein.

Figure 1:
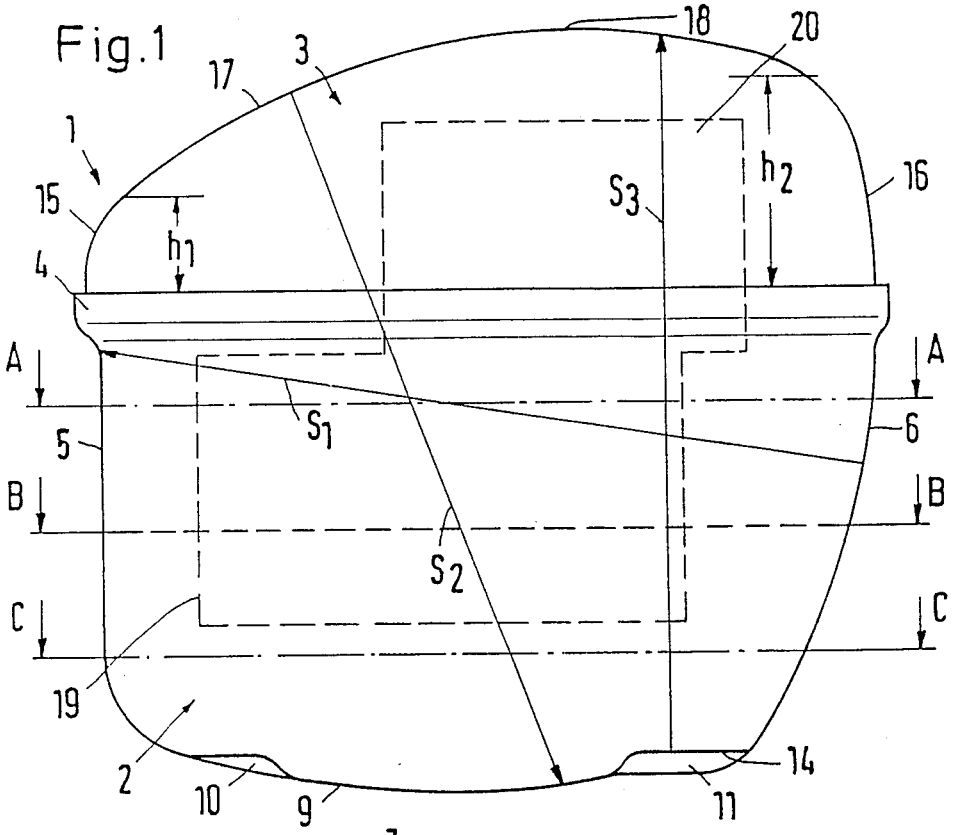
FIG. 1 is a side elevation of a casing according to the invention.

The illustrated casing 1 consists of a lower vessel 2 and an upper cover 3 interconnected by way of a welded edge. The vessel 2 has side walls consisting of a first transverse wall 5, and opposite second transverse wall 6 as well as two symmetrically disposed longitudinal walls 7 and 8, the curvature of the vessel increasing from the centre of the wall towards both ends. At their central portions, the transverse walls are less curved than the central portions of the longitudinal walls. In a vertical section, the first transverse wall 5 extends straight and substantially vertically and the second vertical wall 6 is inclined to the vertical to an increasing extent from the top to the bottom. The linear vertical dimension of wall 5 is more than 50 percent of that of the height of the lower vessel. These conditions are evident from FIGS. 1 and 2 and are reproduced by the sections A—A (chain-dotted), B—B (broken lines) and C—C (long broken lines).

The base wall 9 of the vessel 2 contains four depressions 10, 11, 12 and 13 of which all the base surfaces 14 are disposed in a single plane. The casing can be secured by them.

Above the transverse wall 5 of the vessel, the cover 3 has a transverse wall 15 of shallower height $h_1$ and above the transverse wall 6 of the vessel it has a transverse wall 16 of larger height $h_2$. The height is here so defined that it reaches up to an inclination of 45°. The adjoining wall 17 of the cover has its maximum height in the zone 18, i.e. at a position closer to the second transverse wall 16 of the cover than to the first transverse wall 15. Accordingly, the curvature near the second transverse wall 16 is more intense than near the first transverse wall.

Figure 3:
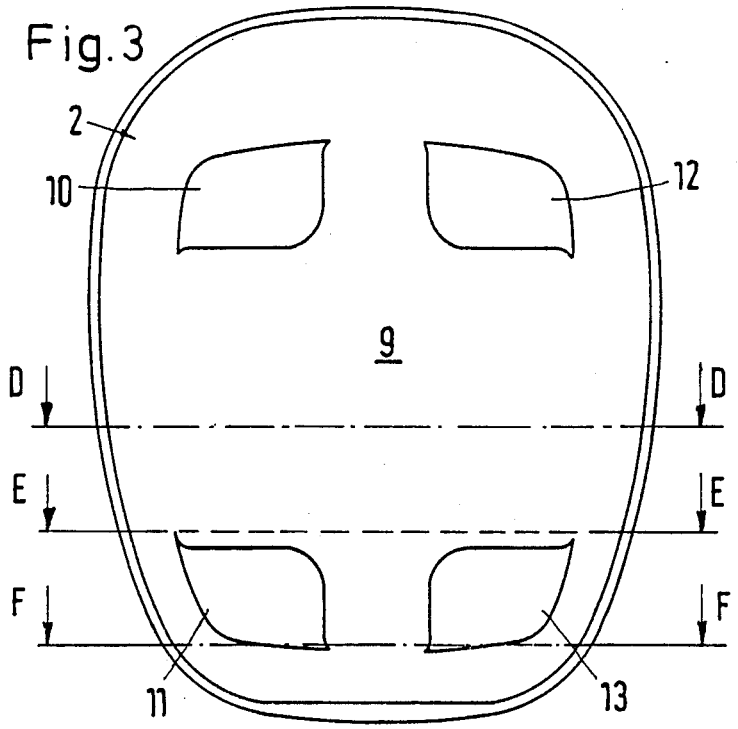
FIG. 3 is an underplan of the casing of FIG. 1.
Figure 4:
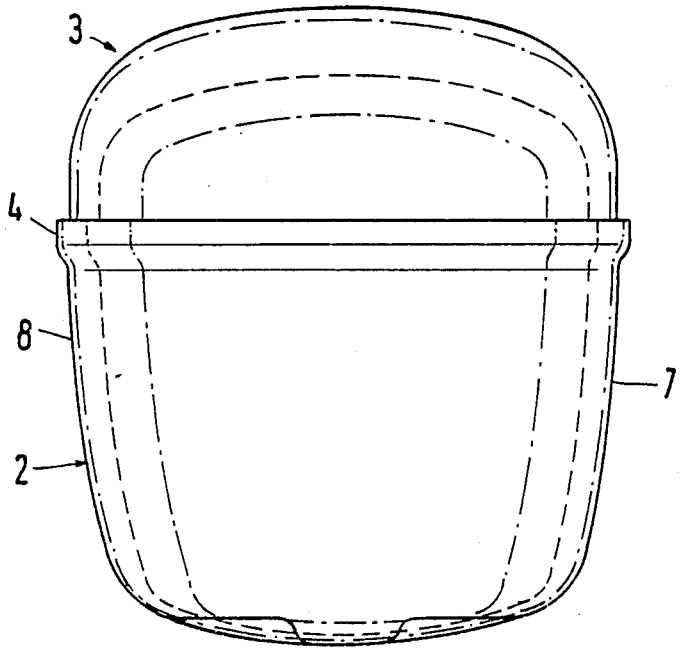
FIG. 4 is an end elevation of the FIG. 1 casing with the sections D—D, E—E and F—F of FIG. 3.

The casing 1 is symmetrical to the central longitudinal plane. The disposition will be evident from the sections through FIG. 3 shown in FIG. 4. The section D—D is shown in chain-dotted lines, the section E—E in broken lines and the section F—F in long broken lines.

Figure 2:
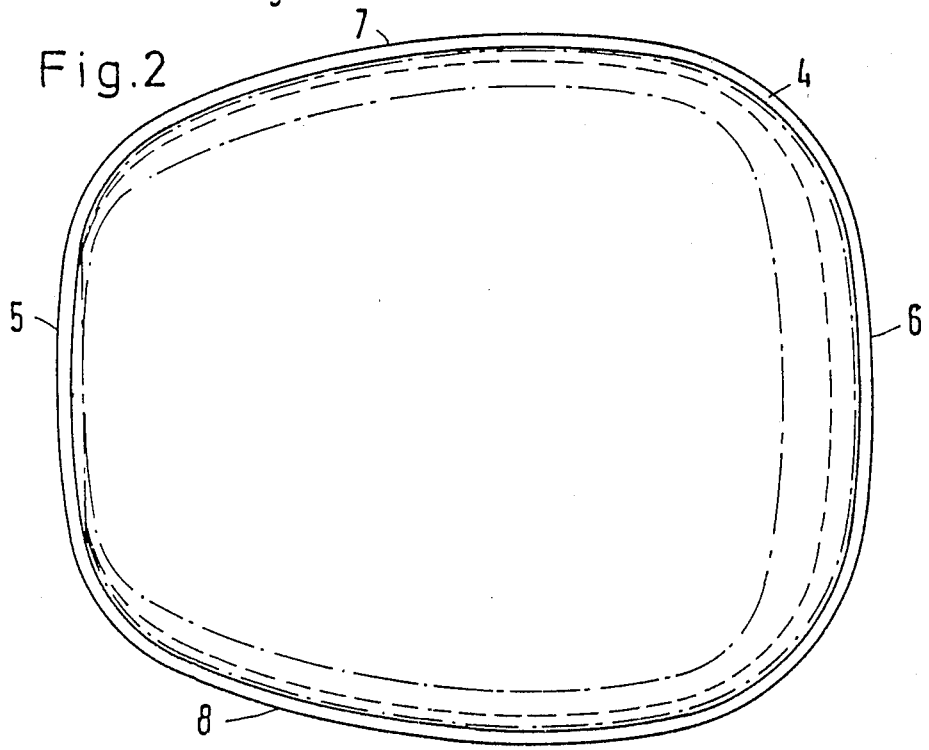
FIG. 2 is a plan view of the vessel and including sections on the lines A—A, B—B and C—C of FIG. 1.

A casing of this shape produces a sound-proof chamber in which no upright waves can be formed. This is because every line drawn perpendicular to any desired wall section meets the opposite wall section at an angle of incidence departing from 90° in at least one plane. This is illustrated in FIG. 1 for three such perpendicular lines $S_1$, $S_2$ and $S_3$. If in one section wall sections appear to run parallel to each other (FIG. 2), in another section (FIG. 1) there is such a departure that the angle of incidence is only 85° or less.

FIG. 1 includes a motor-compressor unit 19 in broken lines, of which the cylinder 20 is adjacent to the second transverse wall 16 of the cover to provide good utilization of the space. Naturally, the walls of the casing may also have a different shape as long as the side walls and possibly the base and cover walls have no zones at which upright waves can be formed.

I claim:

1. A casing for hermetically encapsulated small refrigerators, comprising, a capsule having a lower vessel and an upper cover interconnected along a welded edge, said capsule having side walls inclined relative to each other so that almost any line drawn perpendicular to any one of said walls meets the opposite one of said walls at an angle different from 90°, the angle of incidence departing at least 5° from 90°.

2. A casing according to claim 1 characterized in that said capsule has base and cover sections so inclined to each other that almost any line drawn perpendicular to one of said sections meets the opposite one of said sections at an angle different from 90°.

3. A casing for hermetically encapsulated small refrigerators, comprising, a capsule having a lower vessel and an upper cover interconnected along a welded edge, said capsule having side walls inclined relative to each other so that almost any line drawn perpendicular to any one of said side walls meets the opposite one one of said side walls at an angle different from 90°, the lower vessel side walls including opposite longitudinal walls and a pair of oppositely facing transverse walls having a first wall that is generally vertical and an opposite transverse second wall that extends generally vertically at an angle relative to said first wall.

4. A capsule according to claim 3, characterized in that the first wall is vertically straight and of a vertical dimension that is more than half of the height of the lower vessel.

5. A capsule according to claim 3, characterized in that the second wall extends at an increasing angle to the vertical from its top to its bottom.

6. A capsule according to claim 4, characterized in that the cover has a first transverse wall disposed above the vessel first transverse wall and an opposite second transverse wall, that the cover first transverse wall is of a shallower height than the second transverse wall and that the cover is of a maximum height horizontally more closely adjacent to the cover second transverse wall than the cover first transverse wall.

7. A capsule according to claim 6, characterized in that the cover has a top wall that is more intensely curved in vertical section adjacent to its second transverse wall than adjacent to its first transverse wall.

8. A capsule according to claim 7 wherein a motor-compressor unit is provided in the capsule and has a motor and a compressor on top of the motor with the compressor more closely adjacent to the cover second transverse wall than to the cover first transverse wall.

9. A capsule according to claim 7, characterized in that the vessel longitudinal walls have curved central portions and the vessel transverse walls have central portions of a smaller curvature in horizontal section than the longitudinal central portions.

* * * * *